US010127844B2

(12) United States Patent
Calby et al.

(10) Patent No.: US 10,127,844 B2
(45) Date of Patent: Nov. 13, 2018

(54) SIGN BASE AND SIGN ASSEMBLY

(71) Applicant: AMERICAN LOUVER COMPANY, Skokie, IL (US)

(72) Inventors: Daniel P. Calby, Park Ridge, IL (US); Geoffrey M. Glass, Skokie, IL (US)

(73) Assignee: American Louver Company, Skokie, IL (US)

( * ) Notice: Subject to any disclaimer, the term of this patent is extended or adjusted under 35 U.S.C. 154(b) by 0 days.

(21) Appl. No.: 15/340,042

(22) Filed: Nov. 1, 2016

(65) Prior Publication Data

US 2018/0122279 A1 May 3, 2018

(51) Int. Cl.
*G09F 15/00* (2006.01)

(52) U.S. Cl.
CPC ..... *G09F 15/0056* (2013.01); *G09F 15/0062* (2013.01)

(58) Field of Classification Search
CPC ... G09F 15/0056; G09F 15/0087; E01F 9/692
See application file for complete search history.

(56) References Cited

U.S. PATENT DOCUMENTS 5,088,680 A 2/1992 Farmer
5,732,911 A 3/1998 Kulp et al.
5,860,386 A * 1/1999 Schwab ..... B60Q 7/00 116/63 C
5,875,578 A * 3/1999 Grewe ..... G09F 15/0056 248/346.2
5,878,518 A * 3/1999 Grewe ..... G09F 15/0056 248/910
6,263,601 B1 * 7/2001 Emert ..... G09F 13/04 248/156
7,107,714 B2 * 9/2006 Evans ..... G09F 7/22 40/606.01
7,243,450 B2 7/2007 Dicke et al.
7,584,563 B2 * 9/2009 Hillstrom ..... G09F 15/0056 248/346.2
7,941,951 B2 5/2011 Hillstrom et al.
7,996,980 B2 8/2011 Hillstrom et al.
8,104,205 B2 1/2012 Hillstrom et al.
8,646,196 B2 * 2/2014 Glass, Jr. ..... F16F 1/12 40/607.01
9,257,062 B2 * 2/2016 Molenaar ..... G09F 15/0062
(Continued)

*Primary Examiner* — Gary C Hoge
(74) *Attorney, Agent, or Firm* — McDermott Will & Emery LLP

(57) ABSTRACT

A sign assembly includes a sign panel, a base including an upper surface and a lower surface, a first longitudinal side and a second longitudinal side, the first longitudinal side including a midpoint disposed between first and second outer points, and the second longitudinal side including a midpoint disposed between first and second outer points, and first and second longitudinal sides, and a platform disposed on the base for attaching the sign panel to the base, wherein a distance between the midpoint of the first longitudinal side and the midpoint of the second longitudinal side is less than a distance between the first outer points of the first and second longitudinal sides, and the distance between the midpoint of the first longitudinal side and the midpoint of the second longitudinal side is less than a distance between the second outer points of the first and second longitudinal sides.

20 Claims, 9 Drawing Sheets

(56) References Cited

U.S. PATENT DOCUMENTS

| | | | | |
|---|---|---|---|---|
| 2005/0076552 | A1* | 4/2005 | Tolna | G09F 15/0056 40/607.03 |
| 2012/0066947 | A1* | 3/2012 | Glass, Jr. | B60B 37/00 40/606.02 |
| 2014/0150309 | A1 | 6/2014 | Glass, Jr. et al. | |

* cited by examiner

SIGN BASE AND SIGN ASSEMBLY

TECHNICAL FIELD

The present disclosure generally relates to a sign assembly. In particular, a sign assembly is provided with a base and a releasably-attached sign panel.

BACKGROUND

Standard signs are generally known in the art. Some advertising signs are detachable from a mounting base, while others employ multiple advertising surfaces or dynamic advertising surfaces. However, conventional advertising signs may have difficulty contending with various wind conditions, or with other environmental conditions. Further, bases of conventional advertising signs do not offer properly sized and shaped footprints for many applications and further do not offer enhanced base strength and rigidity. The accessories or integrated features available on these known sign systems do not safely and purposefully address these issues. The present disclosure seeks to overcome some limitations and other drawbacks of the prior art, and to provide new features not heretofore available. A full discussion of the features and advantages of the present disclosure is deferred to the following detailed description, which proceeds with reference to the accompanying drawings.

SUMMARY

In some implementations, the present disclosure provides a sign assembly, including a sign panel, a base including an upper surface and a lower surface, a first lateral side and a second lateral side, and a first longitudinal side and a second longitudinal side, the first longitudinal side including a midpoint disposed between first and second outer points, and the second longitudinal side including a midpoint disposed between first and second outer points, an interior bounded by the upper and lower surfaces, first and second lateral sides, and first and second longitudinal sides, and a platform disposed on the base for attaching the sign panel to the base, wherein a distance between the midpoint of the first longitudinal side and the midpoint of the second longitudinal side is less than a distance between the first outer points of the first and second longitudinal sides, and the distance between the midpoint of the first longitudinal side and the midpoint of the second longitudinal side is less than a distance between the second outer points of the first and second longitudinal sides.

In another implementation, the present disclosure provides a base for supporting a sign, including an upper surface and a lower surface, a first lateral side and a second lateral side, and a first longitudinal side and a second longitudinal side, the first longitudinal side including a midpoint disposed between first and second outer points, and the second longitudinal side including a midpoint disposed between first and second outer points, an interior bounded by the upper and lower surface, first and second lateral sides, and first and second longitudinal sides, and a recessed channel formed on the upper surface and extending substantially between the longitudinal sides, wherein a distance between the midpoint of the first longitudinal side and the midpoint of the second longitudinal side is less than a distance between the first outer points of the first and second longitudinal sides, and the distance between the midpoint of the first longitudinal side and the midpoint of the second longitudinal side is less than a distance between the second outer points of the first and second longitudinal sides.

In some implementations, the present disclosure provides a base for supporting sign, including an upper surface and a lower surface, a first lateral side and a second lateral side, and a first longitudinal side and a second longitudinal side, the first lateral side including a midpoint disposed between first and second outer points, and the second lateral side including a midpoint disposed between first and second outer points, an interior bounded by the upper and lower surface, first and second lateral sides, and first and second longitudinal sides, and a recessed channel formed on the upper surface and extending substantially between the longitudinal sides, wherein a distance between the midpoint of the first lateral side and the midpoint of the second lateral side is less than a distance between the first outer points of the first and second lateral sides, and the distance between the midpoint of the first lateral side and the midpoint of the second lateral side is less than a distance between the second outer points of the first and second lateral sides.

BRIEF DESCRIPTION OF THE DRAWINGS

To understand the present disclosure, it will now be described by way of example, with reference to the accompanying drawings in which embodiments of the disclosures are illustrated and, together with the descriptions below, serve to explain the principles of the disclosure.

The following figures are included to illustrate certain aspects of the present disclosure, and should not be viewed as exclusive implementations. The subject matter disclosed is capable of considerable modifications, alterations, combinations and equivalents in form and function, without departing from the scope of this disclosure.

DETAILED DESCRIPTION

Figure 1:
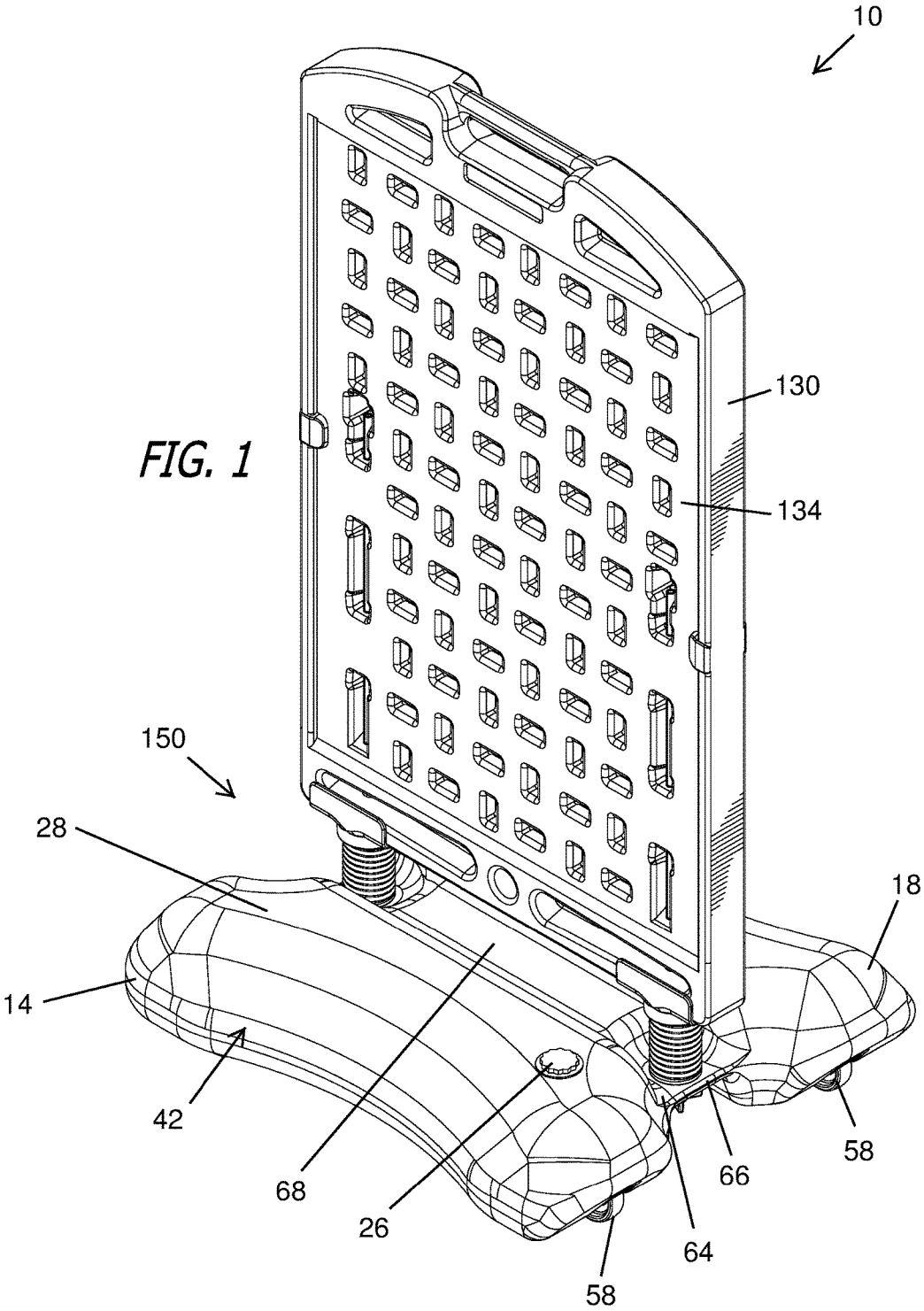
FIG. 1 is a front perspective view of a sign assembly according to some embodiments of the present disclosure.

While the base and sign assembly discussed herein may be implemented in embodiments in many different forms, the disclosure will show in the drawings, and will herein describe in detail, some embodiments with the understanding that the present description is to be considered as an exemplification of the principles of the sign and sign base, and is not intended to limit the broad aspects of the disclosure to the embodiments illustrated.

A sign assembly 10 is commonly used by various entities to inform, advertise, educate and alert viewers to displayed content. Although often used in conjunction with marketing activities, sign assemblies 10 can also be employed in industrial, governmental, crowd-control and political applications. Enhancements to stability, portability, aesthetic design and/or visibility increase sign assembly 10 utility, as will be described below.

Figure 2:
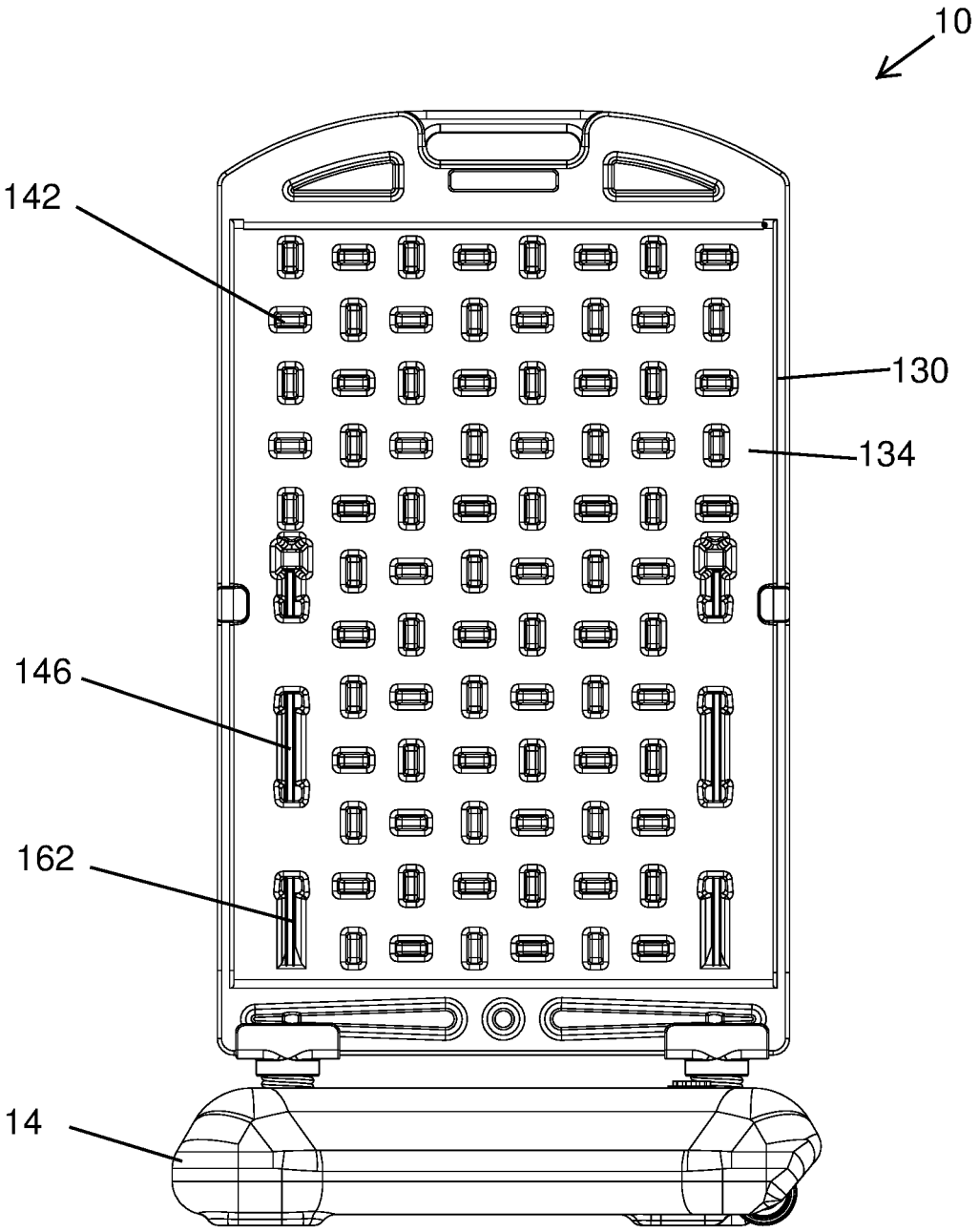
FIG. 2 is a front view of the sign assembly of FIG. 1.
Figure 3:
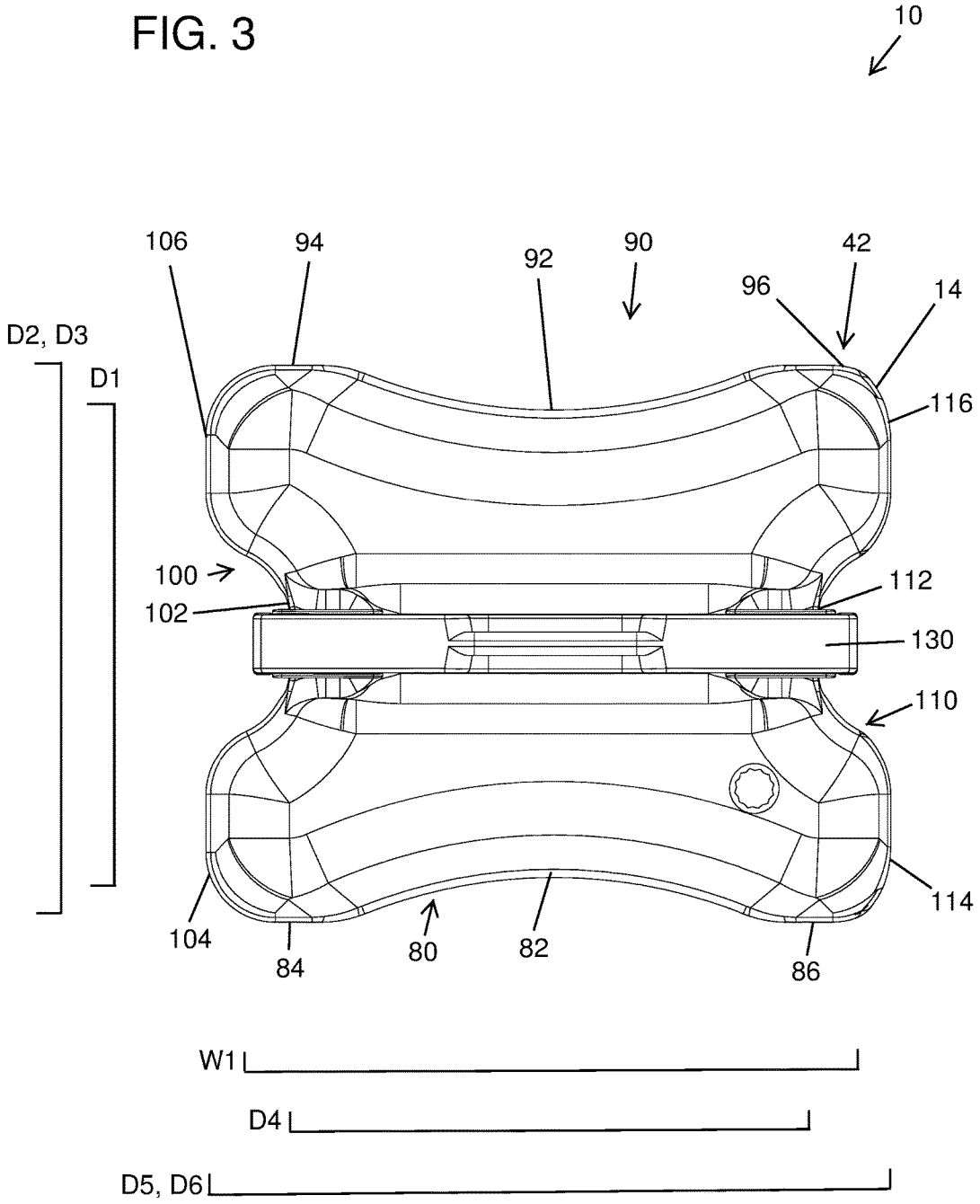
FIG. 3 is a top view of the sign assembly of FIG. 1.
Figure 4:
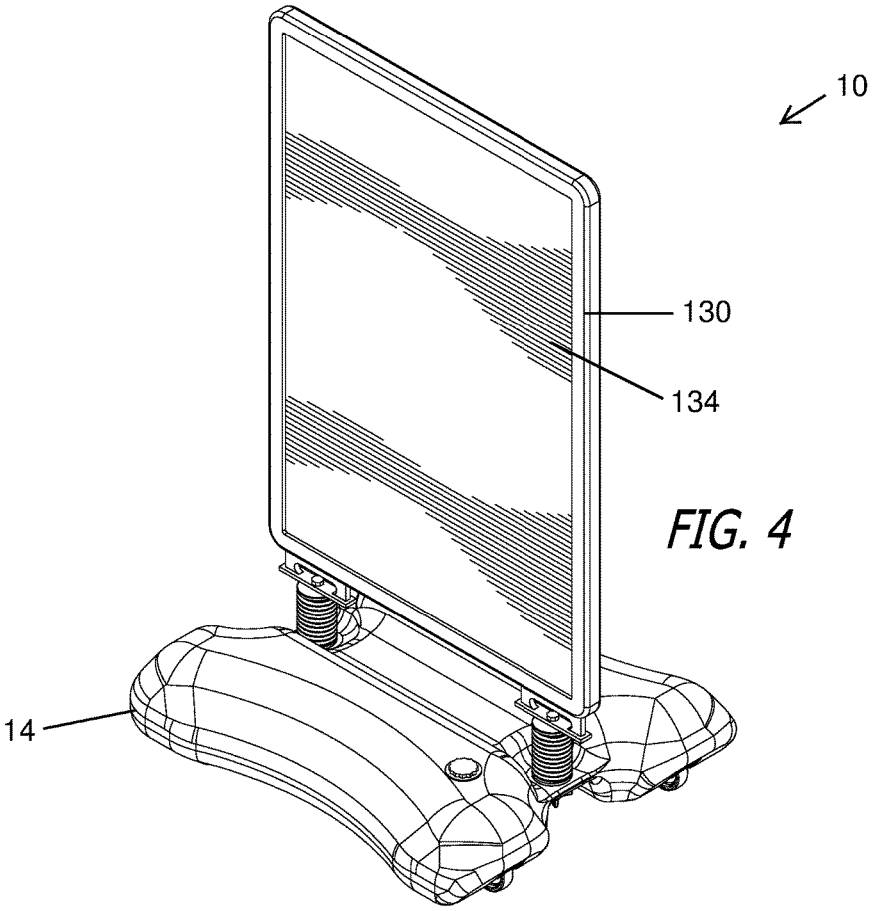
FIG. 4 is a front perspective view of a second sign assembly according to some embodiments of the present disclosure.

Referring now to the figures, and initially to FIGS. 1-3, in some implementations the sign assembly 10 may include a base 14. The base 14 includes an exterior surface 18 surrounding an interior 22. A ballast opening 26 is formed on the exterior surface 18 and allows a liquid or solid ballast to be inserted into, or removed from, the interior 22. Such a removable ballast system aids in the stability and portability of the sign assembly 10.

The exterior surface 18, in some implementations, includes an upper surface 28 and a lower surface 30. The lower surface 30 may include a lower cavity 34, the shape and size of which increases a structural strength of the base 14 and advantageously dictates the volume and ballast distribution of the interior 22. One or more feet 38 may be disposed on the lower surface 30 and serve as contact points between the base 14 and a ground surface when the sign assembly 10 is placed in an upright position on the ground surface. Although often used on a level road surface, the sign assembly 10 may also be positioned on a range of natural and fabricated ground surfaces. The base 14 may comprise a polymer material, and further may be constructed through a blow-molding process. However, the base 14 may also include various metals, alloys or ceramics.

As best shown in FIGS. 1 and 3, a perimeter 42 is formed around the base 14 when viewed from a top perspective. The perimeter 42 may be formed around the exterior surface 18, and around at least portions of the upper surface 28 and lower surface 30. As will be described below, the perimeter 42 may also be formed by an outer edge of a platform.

Figure 11:
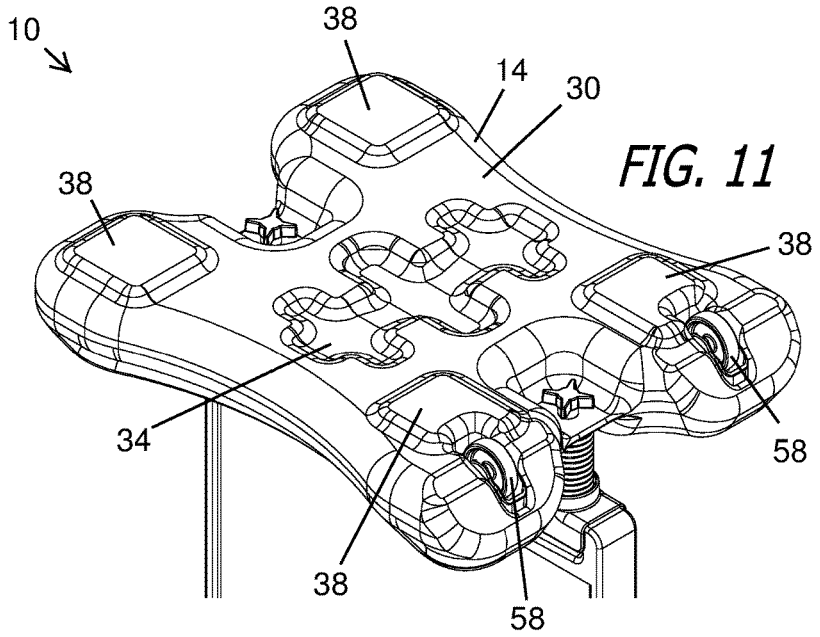
FIG. 11 is bottom perspective view of a base for supporting a sign according to some embodiments of the present disclosure.
Figure 12:
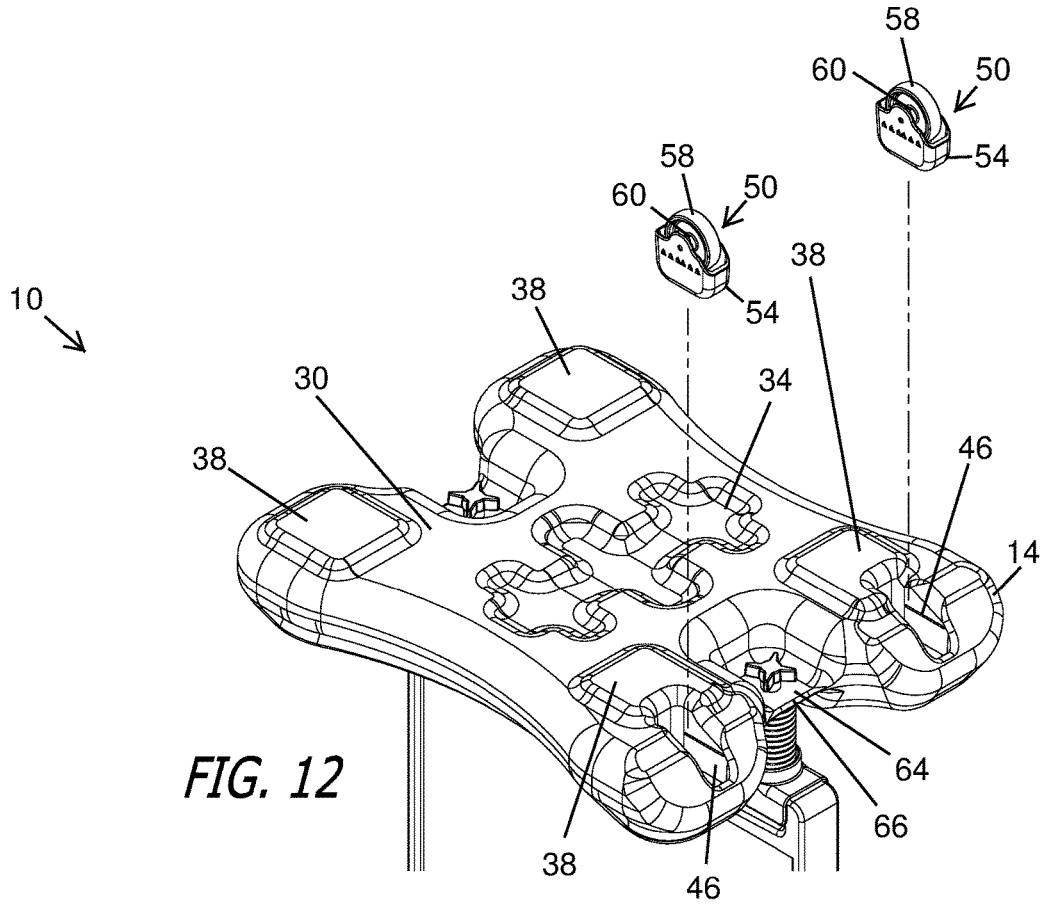
FIG. 12 is a bottom perspective view of the base of FIG. 11, showing wheel housings removed from housing cavities.

In some implementations, one or more housing cavities 46 are formed in the lower surface 30. These are best shown in FIGS. 11 and 12. Each housing cavities 46 accept, permanently or releasably, a wheel assembly 50 containing a housing 54, and a wheel 58 rotatably secured within the housing 54 by an axle 60. The wheels 58, when the wheel assemblies 50 are disposed within the housing cavities 46, allow the sign assembly 10 to be tilted and rolled, allowing for easy transportation.

Figure 10:
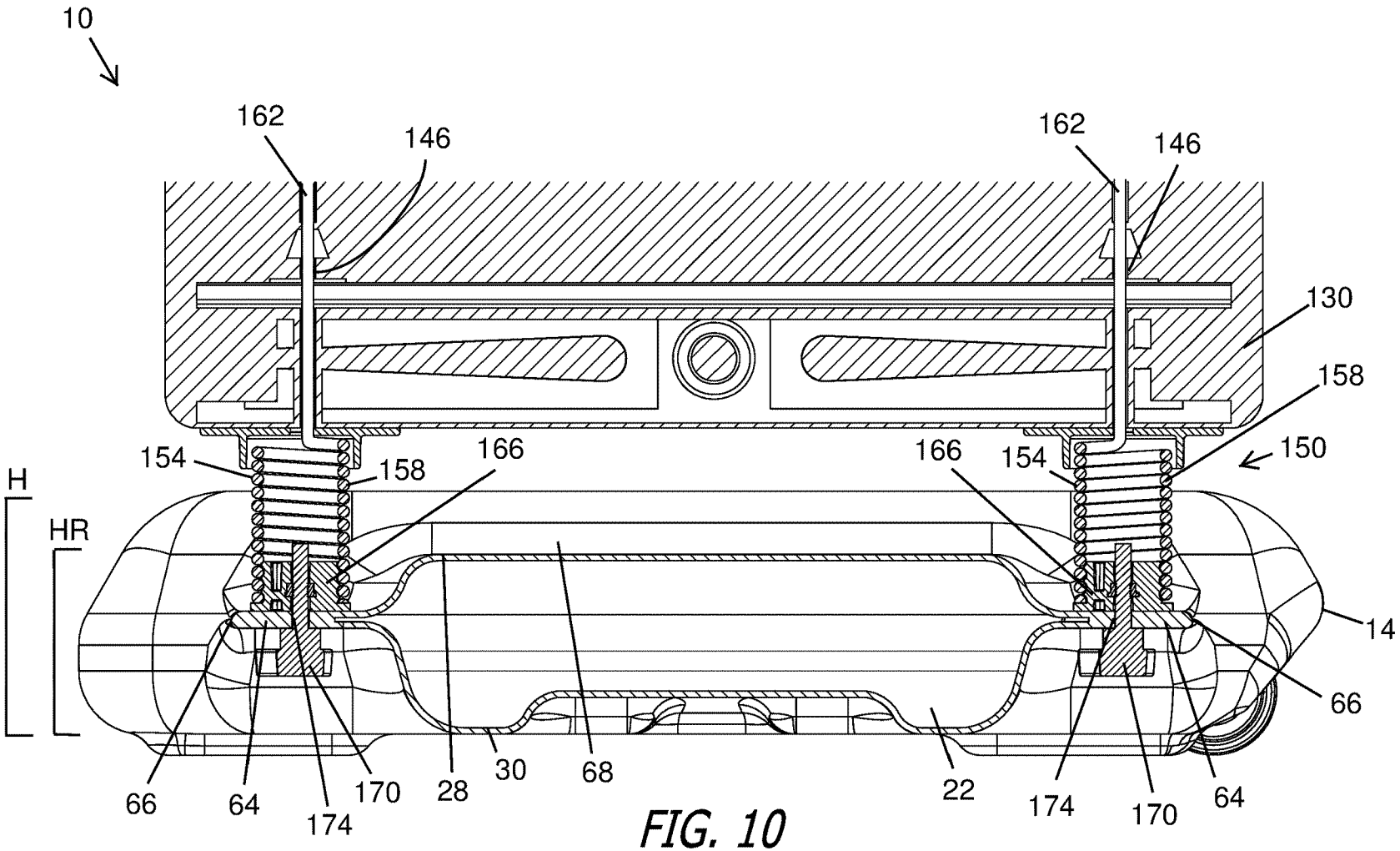
FIG. 10 is a cross-sectional view of a base for supporting a sign according to some embodiments of the present disclosure.

A platform 64 is formed on the exterior surface 18, as best shown in FIG. 10. The platform 64 includes an outer edge 66 which, in some implementations, forms a portion of the perimeter 42. Further, in some implementations, the platform 64 includes a thicker cross-sectional area than does one or both of the upper surface 28 and the lower surface 30. In some implementations, the platform 64 is formed where the upper surface 28 and the lower surface 30 are joined.

As shown in FIGS. 1 and 10, a recessed channel 68 is disposed on the upper surface 28 in some implementations of the present disclosure. The recessed channel 68 may extend between two opposing sides of the base 14. The recessed channel 68 may also extend between two platforms 64 along the exterior surface 18. In some implementations, the recessed channel 68 forms a height HR from the lower surface 30 to the base of the recessed channel that is less than a height H from the lower surface 30 to the upper surface 28, as best shown in FIG. 10.

The base 14 includes a first lateral side 80 including a first lateral midpoint 82, a first lateral first outer point 84 and a first lateral second outer point 86. The base 14 also includes a second lateral side 90 including a second lateral midpoint 92, a second lateral first outer point 94 and a second lateral second outer point 96. These features are best shown in FIGS. 3, 5, 7 and 9. The first lateral midpoint 82 is disposed between the first lateral first outer point 84 and the first lateral second outer point 86, and the first lateral midpoint 82 comprises a midpoint of the first lateral side 80. The second lateral midpoint 92 is disposed between the second lateral first outer point 94 and the second lateral second outer point 96, and the second lateral midpoint 92 comprises a midpoint of the second lateral side 90.

A distance D1 is formed between the first lateral midpoint 82 and the second lateral midpoint 92. A distance D2 is formed between the first lateral first outer point 84 and the second lateral first outer point 94. Additionally, a third distance D3 is formed between the first lateral second outer point 86 and the second lateral second outer point 96. Further, the first lateral side 80 and/or the second lateral side 90 may include a section of substantially constant, non-straight curvature 97 when viewed from a top perspective when the sign assembly is arranged with the lower surface 30 on a ground surface.

In some implementations, D1 is less than D2. In some implementations, D1 is less than D3. In some implementations, D1 is less than each of D2 and D3. In some implementations, one or both of D2 and D3 equals an overall length of the base 14.

The base 14 also includes a first longitudinal side 100 including a first longitudinal midpoint 102, a first longitudinal first outer point 104 and a first longitudinal second outer point 106. The base 14 also includes a second longitudinal side 110 including a second longitudinal midpoint 112, a second longitudinal first outer point 114 and a second longitudinal second outer point 116. These features are best shown in FIGS. 3, 5, 7 and 9. The first longitudinal midpoint 102 is disposed between the first longitudinal first outer point 104 and the first longitudinal second outer point 106, and the first longitudinal midpoint 102 comprises a midpoint of the first longitudinal side 100. The second longitudinal midpoint 112 is disposed between the second longitudinal first outer point 114 and the second longitudinal second outer point 116, and the second longitudinal midpoint 112 comprises a midpoint of the second longitudinal side 110.

A distance D4 is formed between the first longitudinal midpoint 102 and the second longitudinal midpoint 112. A distance D5 is formed between the first longitudinal first outer point 104 and the second longitudinal first outer point 114. Additionally, another distance D6 is formed between the first longitudinal second outer point 106 and the second longitudinal second outer point 116. In some implementations, D4 is less than D5. In some implementations, D4 is less than D6. In some implementations, D4 is less than each of D5 and D6. In some implementations, one or both of D5 and D6 substantially equals an overall width of the base 14.

In some implementations, the sign assembly 10 includes a sign panel 130. The sign panel 130 includes a front surface 134 over which a sign (not shown) can be supported and displayed. A rear surface 138 may also support and display a sign. The sign panel 130, in some embodiments, includes openings 142 that increase sign panel 130 strength and decrease sign panel 130 weight. Grooves 146 may also be formed within the sign panel 130, and be oriented vertically along the sign panel 130. The sign panel 130 may be fabricated from polymers, metals and/or metal alloys, among other suitable materials.

The sign panel 130, in some implementations, is releasably attached to the base 14 via a mounting system 150, as best shown in FIGS. 1, 10 and 11. The mounting system 150 includes one or more spring members 154, the spring members 154 each including a resilient portion 158 and a rod portion 162. The resilient portion 158 may be a coil. A threaded insert 166 attaches to the resilient portion 158, and further attaches to a fastener 170. A threaded portion of the fastener 170 may extend through a mounting aperture 174 of the platform 64 and releasably attach to the threaded insert 166, such that the fastener 170, platform 64 and threaded insert 166 are releasably secured together.

The rod portion 162 extends vertically from the spring member 154 and is frictionally and/or releasably received by the groove 146 in the sign panel 130, as best shown in FIG. 10. By this arrangement, the sign panel 130 is releasably secured to the base 14 when the groove 146 receives the rod portion 162 and the threaded portion of the fastener 170 extends through the mounting aperture 174 of the platform 64 and releasably attaches to the threaded insert 166.

Figure 5:
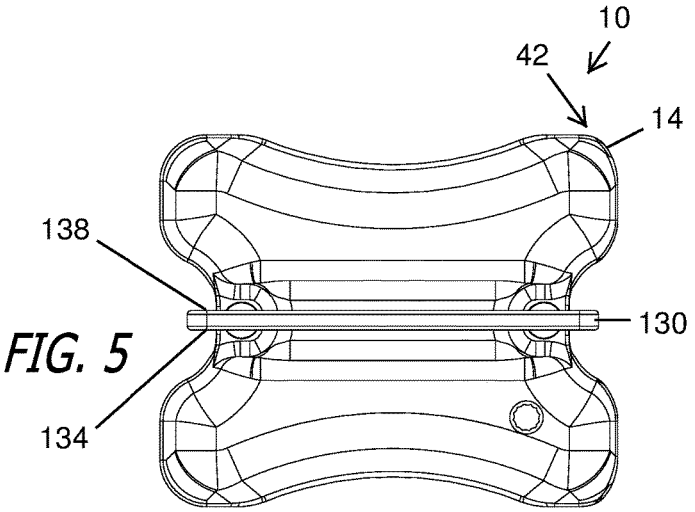
FIG. 5 top view of the sign assembly of FIG. 4.
Figure 6:
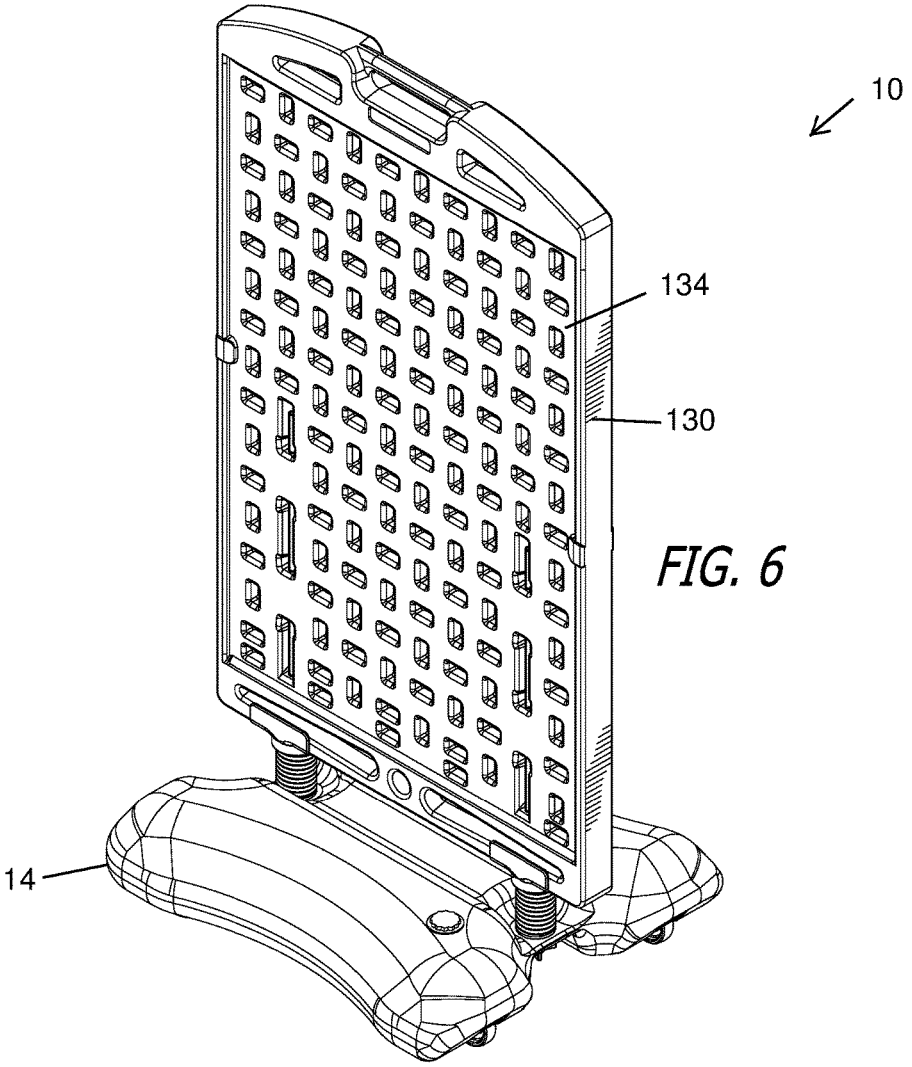
FIG. 6 is a front perspective view of a third sign assembly according to some embodiments of the present disclosure.
Figure 7:
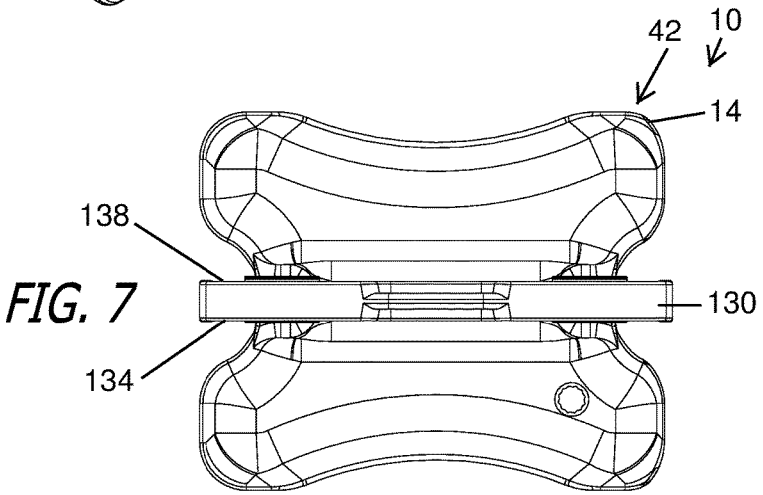
FIG. 7 top view of the sign assembly of FIG. 6.
Figure 8:
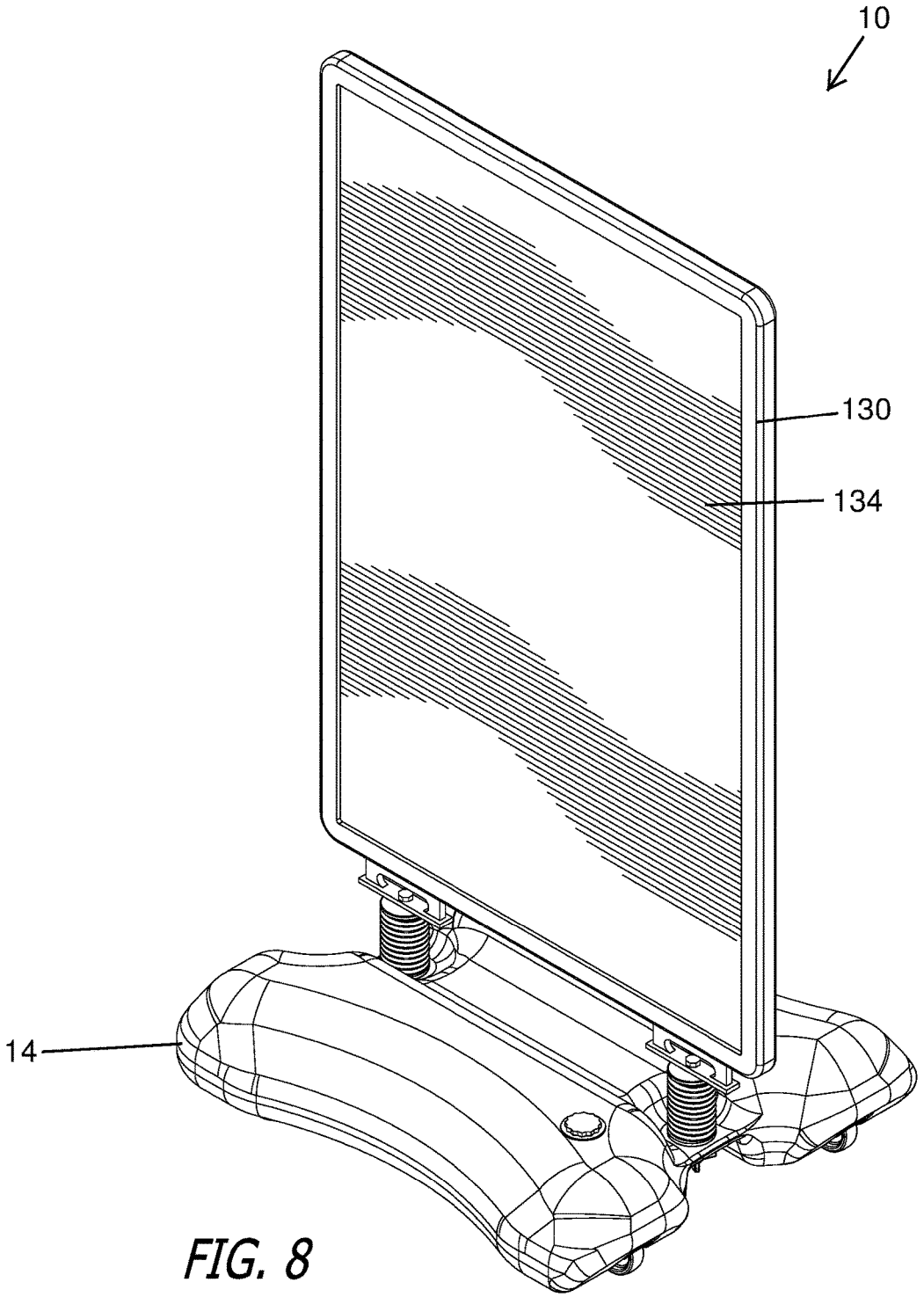
FIG. 8 is a front perspective view of a fourth sign assembly according to some embodiments of the present disclosure.
Figure 9:
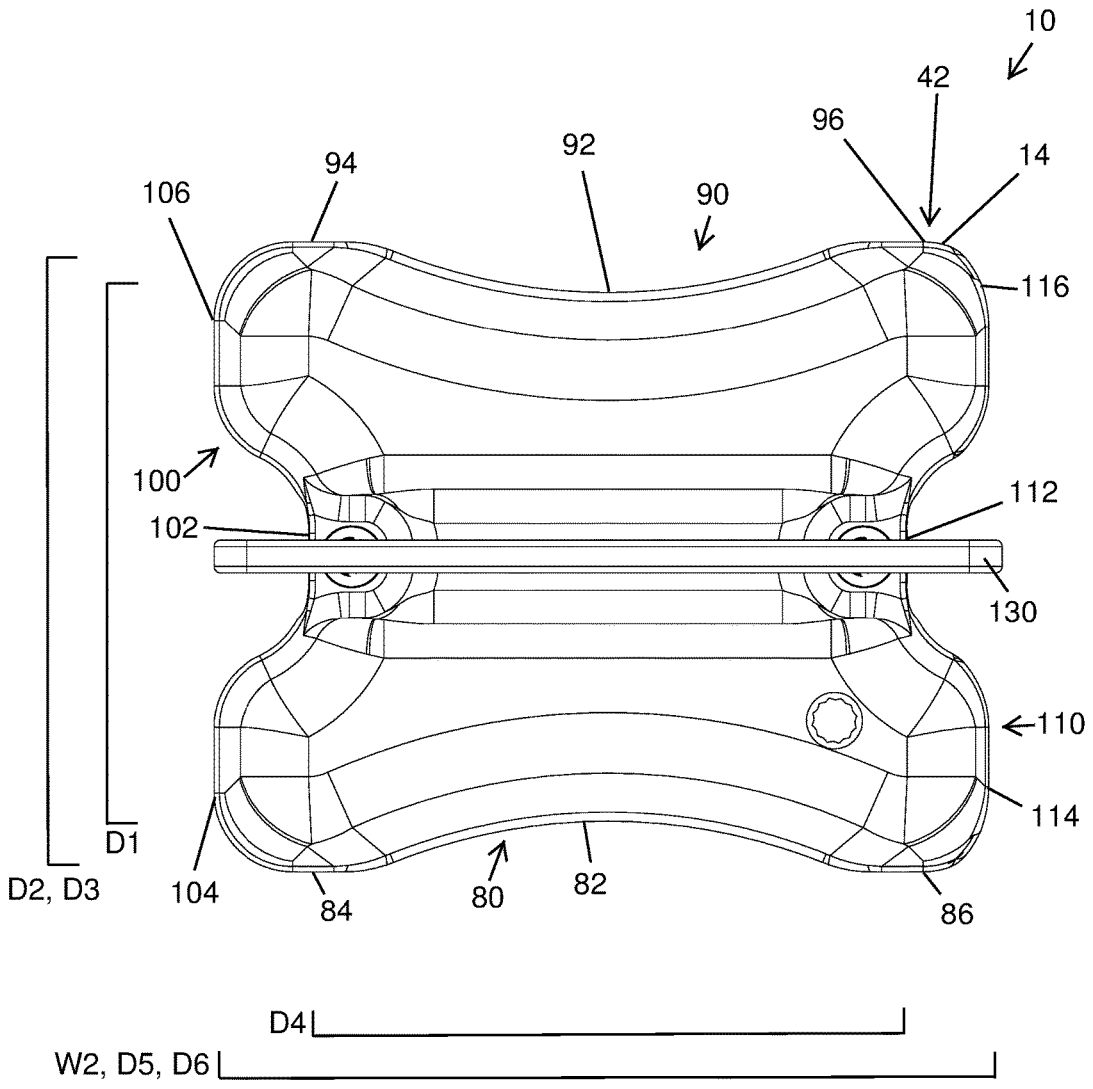
FIG. 9 is a top view of the sign assembly of FIG. 8.

The sign panel 130 has a width when viewed from the top perspective, embodiments of which are shown in FIGS. 3 and 9, among others. In some implementations, a sign width W1 is less than an overall width of the base 14, and the overall width of the base 14 may be D5 or D6, and W1 is also greater than D4. This is best shown in FIGS. 3 and 5. In some implementations, a sign width W2 is substantially equal to an overall width of the base 14, and the overall width of the base 14 may be D5 or D6. This is best shown in FIGS. 7 and 9.

In some implementations, a sign panel 130 width (not shown) is greater than an overall width of the base 14, and the overall width of the base 14 may be D5 or D6. In some implementations, a sign panel 130 width (not shown) is less than D4. In some implementations, a sign width (not shown) is substantially equal to D4.

In some implementations, the first lateral side 80 and the second lateral side 90 include substantially concave curvature when viewed from a top view. In some implementations, the first lateral side 80 and the second lateral side 90 include concave curvature along a majority of their lengths, or along a center part of their lengths.

Additionally, while some implementations of a base 14 have been disclosed with a mounted sign panel 130, it is to be understood that other devices can also be mounted on such a base 14. Such other devices may include a light display, an LED light display, various flags and other flexible visual indicators and various pieces of electronic equipment, among other devices.

While some embodiments have been illustrated and described, numerous modifications come to mind without significantly departing from the spirit of the disclosure, and the scope of protection is only limited by the scope of the accompanying claims. Further, the present disclosure provides a sign base and a sign assembly having increased structural strength, improved aesthetic design, a footprint facilitating flexible sign base placement and a wheel arrangement allowing easy sign assembly transportation.

The disclosed systems and methods are well adapted to attain the ends and advantages mentioned as well as those that are inherent therein. The particular implementations disclosed above are illustrative only, as the teachings of the present disclosure may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative implementations disclosed above may be altered, combined, or modified and all such variations are considered within the scope of the present disclosure. The systems and methods illustratively disclosed herein may suitably be practiced in the absence of any element that is not specifically disclosed herein and/or any optional element disclosed herein. While compositions and methods are described in terms of "comprising," "containing," or "including" various components or steps, the compositions and methods can also "consist essentially of" or "consist of" the various components and steps. All numbers and ranges disclosed above may vary by some amount. Whenever a numerical range with a lower limit and an upper limit is disclosed, any number and any included range falling within the range is specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values. Also, the terms in the claims have their plain, ordinary meaning unless otherwise explicitly and clearly defined by the patentee. Moreover, the indefinite articles "a" or "an," as used in the claims, are defined herein to mean one or more than one of the element that it introduces. If there is any conflict in the usages of a word or term in this specification and one or more patent or other documents that may be incorporated herein by reference, the definitions that are consistent with this specification should be adopted.

As used herein, the phrase "at least one of" preceding a series of items, with the terms "and" or "or" to separate any of the items, modifies the list as a whole, rather than each member of the list (i.e., each item). The phrase "at least one of" allows a meaning that includes at least one of any one of the items, and/or at least one of any combination of the items, and/or at least one of each of the items. By way of example, the phrases "at least one of A, B, and C" or "at least one of A, B, or C" each refer to only A, only B, or only C; any combination of A, B, and C; and/or at least one of each of A, B, and C.

What is claimed is:

1. A sign assembly, comprising:

a sign panel;

a base including an upper surface and a lower surface, a first lateral side and a second lateral side, and a first longitudinal side and a second longitudinal side, the first longitudinal side including a midpoint disposed between first and second outer points, and the second longitudinal side including a midpoint disposed between first and second outer points;

an interior bounded by the upper and lower surfaces, first and second lateral sides, and first and second longitudinal sides; and a platform disposed on the base for attaching the sign panel to the base;

wherein a distance between the midpoint of the first longitudinal side and the midpoint of the second longitudinal side is less than a distance between the first outer points of the first and second longitudinal sides, and the distance between the midpoint of the first longitudinal side and the midpoint of the second longitudinal side is less than a distance between the second outer points of the first and second longitudinal sides.

2. The sign assembly of claim 1, wherein the first lateral side includes a midpoint disposed between first and second outer points, and the second lateral side includes a midpoint disposed between first and second outer points, a distance between the midpoint of the first lateral side and the midpoint of the second lateral side being less than a distance between the first outer points of the first and second lateral sides, and the distance between the midpoint of the first lateral side and the midpoint of the second lateral side being less than a distance between the second outer points of the first and second lateral sides.

3. The sign assembly of claim 1, wherein a width of the sign panel is less than an overall width of the base, and further is greater than a distance between the midpoints of the first and second longitudinal sides.

4. The sign assembly of claim 1, wherein a width of the sign panel is substantially equal to an overall width of the base.

5. The sign assembly of claim 1, wherein the sign panel is fabricated from a polymer.

6. The sign assembly of claim 1, wherein the sign panel is fabricated from a metal.

7. The sign assembly of claim 1, wherein the platform includes an outer edge forming a portion of a base perimeter.

8. The sign assembly of claim 1, wherein the first and second lateral sides include a section of substantially constant, non-straight curvature when viewed from a top perspective when the sign assembly is arranged with the lower surface in contact with a ground surface.

9. The sign assembly of claim 1, wherein the sign panel is removably attached to the base at the platform via a spring member.

10. The sign assembly of claim 9, wherein the spring member includes a resilient and coiled section, as well as a substantially linear and straight portion insertable into grooves in the sign panel.

11. The sign assembly of claim 1, wherein the upper surface and the lower surface join at the platform.

12. The sign assembly of claim 1, wherein at least a portion of the platform is thicker in cross-section than is either the upper surface or the lower surface.

13. The sign assembly of claim 1, wherein the base includes a recess for accepting a wheel housing.

14. A base for supporting a sign, comprising:

an upper surface and a lower surface, a first lateral side and a second lateral side, and a first longitudinal side and a second longitudinal side, the first longitudinal side including a midpoint disposed between first and second outer points, and the second longitudinal side including a midpoint disposed between first and second outer points;

an interior bounded by the upper and lower surface, first and second lateral sides, and first and second longitudinal sides; and a recessed channel formed on the upper surface and extending substantially between the longitudinal sides;

wherein a distance between the midpoint of the first longitudinal side and the midpoint of the second longitudinal side is less than a distance between the first outer points of the first and second longitudinal sides, and the distance between the midpoint of the first longitudinal side and the midpoint of the second longitudinal side is less than a distance between the second outer points of the first and second longitudinal sides.

15. The base of claim 14, wherein a distance between the midpoint of the first lateral side and the midpoint of the second lateral side is less than a distance between the first outer points of the first and second lateral sides, and the distance between the midpoint of the first lateral side and the midpoint of the second lateral side is less than a distance between the second outer points of the first and second lateral sides.

16. The base of claim 14, wherein the base includes a platform disposed on the base for attaching a sign panel to the base, the platform including an edge forming part of a base perimeter.

17. The base of claim 14, further including a sign panel having a width less than an overall width of the base, and the sign panel having a width greater than a distance between the midpoints of the first and second longitudinal sides.

18. The base of claim 14, further including a sign panel having a width substantially equal to an overall width of the base.

19. The base of claim 15, wherein the first and second lateral sides include a section of substantially constant, non-straight curvature when viewed from a top perspective when the base is arranged with the lower surface in contact with a ground surface.

20. A base for supporting sign, comprising:

an upper surface and a lower surface, a first lateral side and a second lateral side, and a first longitudinal side and a second longitudinal side, the first lateral side including a midpoint disposed between first and second outer points, and the second lateral side including a midpoint disposed between first and second outer points;

an interior bounded by the upper and lower surface, first and second lateral sides, and first and second longitudinal sides; and a recessed channel formed on the upper surface and extending substantially between the longitudinal sides;

wherein a distance between the midpoint of the first lateral side and the midpoint of the second lateral side is less than a distance between the first outer points of the first and second lateral sides, and the distance between the midpoint of the first lateral side and the midpoint of the second lateral side is less than a distance between the second outer points of the first and second lateral sides.

* * * * *